US007373745B1

(12) United States Patent
Massaad

(10) Patent No.: US 7,373,745 B1
(45) Date of Patent: May 20, 2008

(54) VISOR MOUNTED PLACARD HOLDER

(76) Inventor: John Massaad, 2781 Timberwood Dr., Broadview Hts., OH (US) 44147

( * ) Notice: Subject to any disclaimer, the term of this patent is extended or adjusted under 35 U.S.C. 154(b) by 13 days.

(21) Appl. No.: 11/535,156

(22) Filed: Sep. 26, 2006

(51) Int. Cl.
*G09F 21/04* (2006.01)

(52) U.S. Cl. ..... 40/593; 296/97.6

(58) Field of Classification Search ..... 40/593, 40/647, 643, 644; 297/97.6
See application file for complete search history.

(56) References Cited

U.S. PATENT DOCUMENTS

| | | | | |
|---|---|---|---|---|
| 1,534,151 | A | 4/1925 | Bahsler | |
| 2,377,225 | A | 5/1945 | Gisleson | |
| 2,637,128 | A | 5/1953 | Weeks | |
| 2,736,374 | A * | 2/1956 | Iverson | 160/220 |
| 2,825,988 | A | 3/1958 | O'Reilly | |
| 2,916,838 | A | 12/1959 | Campbell | |
| 4,280,730 | A * | 7/1981 | Turner | 296/97.6 |
| 4,352,519 | A * | 10/1982 | Aro | 296/97.6 |
| 5,829,816 | A * | 11/1998 | Cimmino | 296/97.6 |
| 6,029,384 | A * | 2/2000 | McLaughlin | 40/737 |
| 6,163,997 | A * | 12/2000 | Deralas | 40/745 |
| 6,276,081 | B1 | 8/2001 | Shedd | |
| 6,564,981 | B2 | 5/2003 | Murphy | |
| 6,663,063 | B2 | 12/2003 | Tatta | |
| 6,708,435 | B2 | 3/2004 | Massey | |
| 2004/0016162 | A1 | 1/2004 | Rendon | |
| 2005/0230998 | A1 * | 10/2005 | Im | 296/97.6 |

OTHER PUBLICATIONS

Louis G. Renteria, New Product Announcement, web page(s)., Mar. 25, 2006, 5 printed pages, http://www.geocities.com/Olivia_Davidson/?200625.

* cited by examiner

*Primary Examiner*—Cassandra Davis
(74) *Attorney, Agent, or Firm*—D.A. Stauffer Patent Services LLC; Dwight A. Stauffer

(57) ABSTRACT

A placard holder device that removeably holds for display an informational placard that can be viewed through the windshield of a parked vehicle, and which enables simple and quick manual repositioning into a stored position that does not obstruct the line of sight through the windshield. Only a single action step is needed to make the placard visible or invisible. The device features: a frame that removeably holds the placard for display, a mounting body having a hinged connection to the frame, a clasp distal to the hinged connection for releasably clasping the frame to the body, and a clip for removable attachment to a visor of the vehicle. Examples of informational placards include: handicapped or parking passes; identifications of a parked vehicle of a member of the media/press, or of a delivery service; placards that display information about a vehicle at a car show or dealership.

14 Claims, 2 Drawing Sheets

VISOR MOUNTED PLACARD HOLDER

TECHNICAL FIELD OF THE INVENTION

The present invention relates to placard holders for use in vehicles and, more particularly, for said holders which are removeably attached to a visor, releasably hold the placard, and which enable positioning the placard either in view or not in view according to the desire of the user.

BACKGROUND OF THE INVENTION

Currently, many informational placards are required to be displayed and easily viewed through the windshield of parked vehicles for various reasons. Some placards, such as handicapped parking permits, are required by law to be displayed in a visible and easy way to identify the vehicle as being legally parked in its designated space. Other placards, such as media/press and delivery, are used to identify the purpose of a parked vehicle, and some other placards, such as in car shows and car lots, are used to display features of a parked vehicle.

In such cases, these placards are temporarily displayed, and since most of them are hung onto the post of the rearview mirror, they are required by law to be removed while the vehicle is in operation due to the danger associated with blocking the driver's line of sight. Since most of these placards are made from thin, rather fragile materials, displaying and removing them frequently will cause damage to them, especially under extremes of hot and cold that can be present throughout the seasons of the year. Also, removing a placard before driving may cause it to be lost since the driver may lay it down or store it in various places about the vehicle.

Prior art devices are exemplified by a Placard Support For Vehicle Visor disclosed in U.S. Pat. No. 6,276,081 (Shedd; 2001) which requires that a base (16) be attached to a surface of a visor, for example using adhesively applied hook and loop attachment strips (18). Shedd's device also includes a pivot connection (24) between a corner of the base and a corresponding corner of the placard or preferably a placard retainer body (34) having one or more clips (22) which grasp the top portion of the placard. Thus there are two steps for displaying the placard: one is to pull down the visor, and a second step is to rotate the placard around the pivot.

Several disadvantages of devices such as Shedd's are apparent. Either the base or at least one side of the base attachment strips are permanently attached to the visor marring its appearance, and complicating installation of the device as well as requiring base attachments on every visor to which the user may wish to mount the placard while moving the placard from one car to another or from the driver's visor to the passenger's visor. Such an attachment is not practical for use in borrowed or leased vehicles, and adhesive attachment likely will not work on visors having uneven and/or fabric surfaces. Placards such as handicapped signs tend to curl and to become brittle under hot and cold conditions, thereby interfering with pivoting the placard across the parallel surface of the base. Shedd's retainer body grips only the top portion of the placard, thereby making it likely that the placard will slip from the retainer clips as the placard is pushed around the pivot. Also, the retainer body covers the view of the top portion of the placard, which may be a problem for placards that display information all the way to the top of the placard. Finally, the two step operation of positioning the placard for display is inconvenient.

Therefore it is an object of the present invention to provide an inexpensive, easy to use placard display device for vehicles. The device should be easily moved from one vehicle or visor to another. Ease of use should involve only one action step to either display or hide the placard. The holder should enable easy insertion/removal of a variety of placard sizes and shapes. The placard should be removeably held in a transparent frame that will help prevent placard deterioration and that will display the informational graphics on at least one face of the placard.

BRIEF SUMMARY OF THE INVENTION

According to the invention, a placard holder for mounting on a visor in a vehicle is disclosed wherein the holder comprises a mounting body hingedly connected to a display frame that holds a placard; and wherein the mounting body comprises: an elongated base extending from a hinge to a frame clasp that is spring biased to releasably clasp the display frame against the base when the display frame is swung on the hinge into the frame clasp; and a visor clip on the opposite side of the base from the frame clasp, the visor clip being spring biased toward the base for spring clipping the mounting body onto the visor, thereby removeably mounting the placard holder on the visor.

Further according to the invention, the frame clasp is located at an end of the elongated base distal to the hinge and is oriented for clasping an end of the display frame distal to its hinge connection. In a preferred embodiment, the mounting body is made of formed wire; and the hinge comprises a hinge loop formed at the hinge end of the elongated base and a mating hinge hole formed at the hinge end of the display frame such that the hinge loop loosely passes through the mating hinge hole.

Further according to the invention, the display frame comprises a planar front, a planar back, and a spring biasing the front against the back for removeably holding the placard between the front and the back; wherein the front is transparent such that information on the placard is displayed through the front. Even further, the display frame is a single sheet of material that is folded over on itself such that one folded edge is the bias spring of the display frame. In a preferred embodiment, the front and back are elongated such that the back extends beyond one elongated end of the front; the hinged connection is between the extended portion of the back and the mounting body; and an edge of the front is curved away from the back for easing insertion of the placard into the display frame.

According to the invention, the placard holder further comprises a single length of springy material that is formed into a clasp at a first end, then extends to form a planar base, then is looped to form a body portion of the hinge, and then finally is curved back to form a spring clip at a second end, opposite the first end, of the springy material. In a preferred embodiment, the single length of springy material is metal; and the display frame is a single length of transparent plastic sheet material that is folded over on itself to form a front and a back that are springingly held together by a folded edge.

According to the invention, a placard holder for mounting on a visor in a vehicle is disclosed wherein the holder comprises: an elongated mounting body having an elongated base with a frame clasp at a first end of the base and a first portion of a hinge at a second end of the base distal to the first end; a visor clip for removeably mounting the holder on the visor, the visor clip positioned on a first side of the plane of the base, opposed to the frame clasp which extends away from the opposed second side of the plane of the base; a display frame with a back, a front, and a spring that biases the back against the front for removeably holding the placard; and a second portion of the hinge at an end of the display frame, the second portion mating with the first portion of the hinge for hingedly connecting the display frame to the mounting body.

Further according to the invention, the display frame is shaped and positioned such that it can hingedly swing into the frame clasp for releasably clasping the display frame against the second side of the base; and the frame clasp has a spring that biases the display frame against the base when the display frame is pushed into the frame clasp, and that opposes pressure which can be applied by a user to the frame clasp for unclasping the display frame.

Further according to the invention, the display frame front is transparent for displaying information on a placard that is removeably held in the display frame.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications. Such relationships, if any, between similar elements in the same or different figures will become apparent throughout the specification, including, if applicable, in the claims and abstract.

Figure 1:
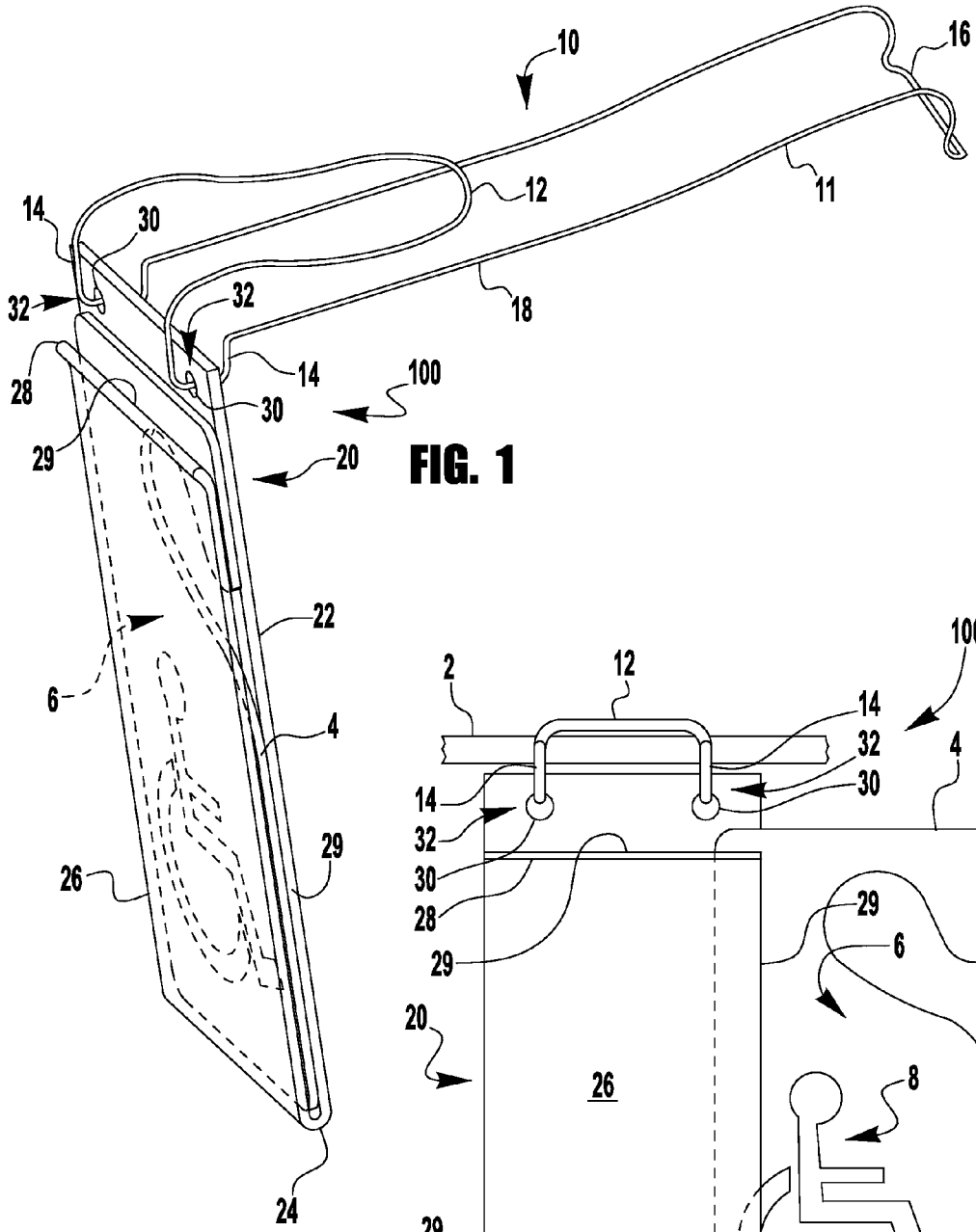
Figure 2:
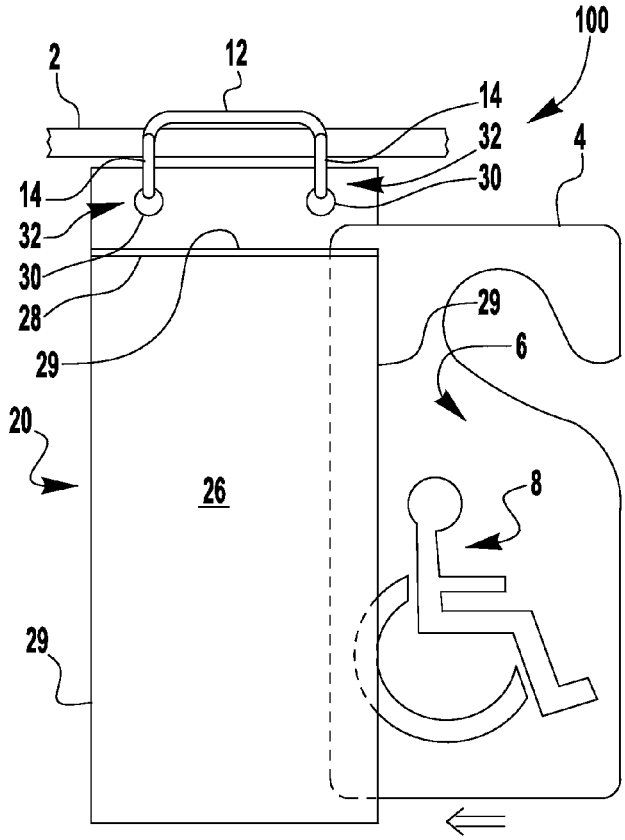
Figure 3:
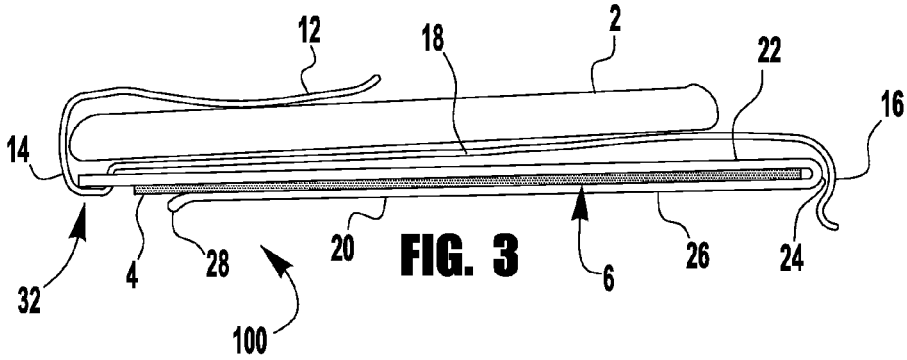
Figure 4:
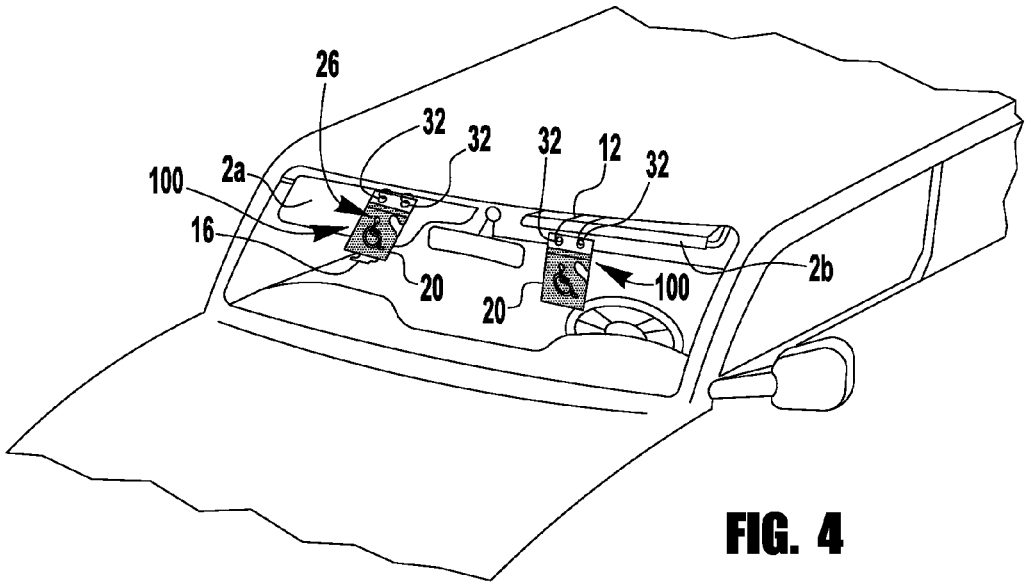

The structure, operation, and advantages of the present preferred embodiment of the invention will become further apparent upon consideration of the following description taken in conjunction with the accompanying drawings, wherein:

FIG. 1 is a perspective view of a placard holder in an opened state, all according to the invention;

FIG. 2 is a front view of the opened holder of FIG. 1 wherein the holder is removeably attached to a vehicle visor and showing a placard being removed from the holder, all according to the invention;

FIG. 3 is a side view of the holder of FIG. 1 but in a closed state and wherein the holder is removeably attached to a vehicle visor, all according to the invention; and FIG. 4 is a front perspective view of two of the holders of FIG. 1, illustrating two exemplary methods of displaying a placard using the holder according to the invention.

DETAILED DESCRIPTION OF THE INVENTION

Referring now to the drawings, the Figures show various views of one embodiment of the inventive placard holder 100, wherein the illustrated embodiment implements features of the invention using a formed wire body 10 and a thermoformed transparent plastic display frame 20. Given the teachings of the present disclosure it will become apparent that functional equivalents of the inventive features described herein can be implemented in many different shapes and forms and materials, all of which are intended to be within the scope of the present invention.

Referring to FIGS. 1-3 and particularly to FIG. 1, the inventive placard holder 100 is seen to have a mounting body 10 hingedly connected to a display frame 20. In this embodiment, the body 10 is made of formed wire 11 that is somewhat springy (e.g., spring steel wire). The mounting body 10 includes an elongated base 18. At one end of the base 18 the body's portion of a hinge 32 is provided by forming a pair of hinge loops 14 that extend downward a short distance determined by the thickness of the display frame 20. Above the base 18 a clip portion 12 is formed in such a way that there is a downward spring bias sufficient to grip (clip onto) a common range of thicknesses for a visor 2 (not part of the invention) as shown in FIGS. 2 and 3, thereby gripping the visor 2 between the clip portion 12 and the base 18. At the end of the base 18 distal to the hinge 32, a clasp portion 16 is formed at a distance determined by the length of the display frame 20 such that when the holder 100 is in a closed state as illustrated in FIG. 3, an edge (e.g., folded end 24) of the display frame 20 is clasped by the clasp portion 16. The clasp portion 16 extends downward a short distance determined by the thickness of the display frame 20, and has a spring bias toward the hinge 32 such that when folded up, the display frame 20 is spring clasped between the clasp portion 16 and the hinge 32. Also because of the springy nature of the clasp portion 16, it is a simple matter to release the display frame 20 by pushing the clasp portion 16 upward and/or outwards, thereby allowing the frame 20 to hingedly swing down to change the holder 100 from a closed state as in FIG. 3 to an opened state as in FIGS. 1 and 2. It should be noted that an equivalent clasping functionality could be achieved, for example, by a spring biased clasp portion that engages with a side edge (e.g., open edge 29) of the display frame 20 and therefore would not require as long a base 18.

Still referring to FIGS. 1-3, the display frame 20 has a back 22 and a front 26 that are joined by a spring biased edge 24 such that the back 22 is biased against the front 26 in order to grip a placard 4 (not part of the invention) that is inserted between the front 26 and the back 22. In this embodiment the display frame 20 is made of plastic, for example transparent thermoformed acrylic sheet material that is folded over on itself along one edge 24. If formed properly, there will be enough space allowed between the front 26 and back 22 to accommodate a typical range of placard thicknesses. The plastic material should have enough flexibility to provide a spring bias at the folded edge 24. Although preferably a fold at the bottom edge as shown, the spring bias edge 24 could be, for example, along part or all of any of the display frame's edges, or for example, it could take the form of a separate spring clip 24 (not a fold) that provides the desired functionality of biasing the front 26 against the back 22. The front's top edge, for example, can have an optional insertion lip 28 that diverges outward for easing insertion of a placard 4 between the front 26 and the back 22. The frame's portion of the hinge 32 is provided by forming hinge holes 30 at the top edge of the back 22 in positions corresponding to the positions of the hinge loops 14 such that each hinge loop 14 can loosely pass through the corresponding (mating) hinge hole 30. In other words, the hinge hole 30 is bigger than the wire 11 of the hinge loop 14 by enough of a margin to enable easy, nonbinding movement of the display frame 20 around the hinge loop 14.

At least the front 26 and preferably also the back 22 is transparent such that information 8 (graphics, possibly including text) on at least a front side 6 of the placard 4 will be visible when the placard 4 is placed in the display frame 20, i.e., pushed through an open edge 29 between the front 26 and the back 22 as illustrated in FIG. 2. It is desirable to have a transparent back 22 because that allows more flexibility in the use of the holder 100. For example, a placard 4 having display information 8 on both sides 6 could be simultaneously viewed from both the front and the back of a vehicle. For example, the holder 100 can be clipped (removeably attached) with the hinge 32 being at either the front (pivot) edge or the back (free) edge of the visor 2. When the hinge 32 is at the front edge of the visor 2, as shown in FIG. 4, then the placard information 8 will be visible through the transparent front 26. When the hinge 32 is at the back edge of the visor 2 (not shown) then the placard information 8 will be visible through the transparent back 26 providing that the holder 100 is opened to let the display frame 20 hang down from the back edge of the visor 2. Of course the "transparent" functionality of the front 26 and/or the back 22 can also be provided, for example, by using an opaque picture frame-like rectangle with a cutout open center (e.g., sheet metal with a center portion cut out to be an open window).

FIG. 2 shows the inventive placard holder 100 in an open state with the clip portion 12 clipped over the visor 2 and the display frame 20 hanging down from the hinge 32.

FIG. 3 shows the inventive placard holder 100 in a closed state with the clip portion 12 clipped over the visor 2 and the display frame 20 held against the base 18 under the visor 2 by the clasp portion 16.

FIG. 4 shows two examples of usage for the inventive placard holder 100. On the driver's visor 2*b* the holder 100 is removeably attached to the visor 2*b* by means of the clip portion 12 shown passing over the top of the visor 2*b* which is raised into its normal stored position, and the display frame 20 has been unclasped and allowed to hingedly swing down to an open state hanging from the hinge 32 and displaying the placard 4 in the display frame 20 such that the placard 4 is viewable through the front windshield of the car. To take the placard 4 out of view, the display holder 20 would be swung up and pressed into the clasp portion 16. On the passenger's visor 2*a*, the holder 100 is similarly attached to the visor 2*a*, but the display frame 20 is clasped between the clasp portion 16 and the hinge 32, thereby holding the display frame 20 against the underside of the visor 2*a*. In this case, the visor 2*a* has been lowered to an un-stored (in use) position, thereby positioning the display frame 20 such that the placard 4 is viewable through the front windshield of the car. To take the placard 4 out of view, the visor 2*a* would be raised to its stored position.

It should be apparent that the inventive placard holder 100 is very easy to use. A placard (e.g., 4) can be changed or moved between holders 100 by simply sliding it into any of the open (unfolded) edges 29, especially one that has the optional insertion lip 28. The placard holder 100 can be removeably attached to any visor 2 (e.g., passenger's visor 2*a* or driver's visor 2*b*) simply by pushing the clip portion 12 onto any edge of the visor 2. To move a placard 4 from one vehicle to another, the holder 100 with the placard 4 in it can be simply pulled off of the visor 2 in the one vehicle and pushed onto any one of the visors 2 in the other vehicle. When the placard holder 100 is removed from a visor 2, there won't be any unsightly attachment means left on the visor 2, such as adhesive or Velcro or a screw hole, etc. as with prior art holders. Finally, use of the placard holder 100 after it has been removeably attached to a visor 2 involves a quick and simple single step method. To display a placard 4 that is in the holder 100, either push on the clasp portion 16 to allow the display frame 20 to swing down, or lower the visor 2. To hide the placard 4 that is in the holder 100, either swing up the display frame 20 into the clasp portion 16 (if the visor 2 is raised), or raise the visor 2.

Thus it can be seen that the inventive placard holder 100 as disclosed herein has a number of advantages including:

- Inexpensive.
- Easy, simple, low effort usage.
- Can be moved from one car to another easily.
- One action to display placard, and one to store it out of sight.
- Placard is enclosed in a frame that accommodates a variety of placard sizes.
- Placard is enclosed in a frame that helps prevent placard warping, curling, or embrittling due to temperature variations and sunlight exposure.
- A handicapped permit, parking permit, press pass, delivery identifier, car feature listing, for sale sign, and any other temporarily displayed placard can be easily displayed and easily stored into an invisible location (note legal requirement that a handicapped placard must be removed while driving so that the placard doesn't interfere with the driver's view).

These and possibly other advantages of the placard holder 100 are attained through the use of novel features in combination as disclosed, the inventive features including: a mounting body 10 with a frame clasp (e.g., 16), a first portion (e.g., 14) of a hinge (e.g., 32), and a visor clip (e.g., 12); plus a display frame 20 with a spring bias (e.g., folded edge 24) that biases a back 22 against a front 26, and a mating second portion (e.g., 30) of the hinge (e.g., 32) that hingedly connects the display frame 20 to the mounting body 10.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A placard holder for mounting on a visor in a vehicle, the holder comprising:

a mounting body hingedly connected to a display frame that holds a placard;

wherein the mounting body comprises:

an elongated base extending from a hinge to a frame clasp that releasably clasp the display frame against the base when the display frame is swung on the hinge into the frame clasp; and a visor clip on the opposite side of the base from the frame clasp, the visor clip being spring biased toward the base for spring clipping the mounting body onto the visor, thereby removeably mounting the placard holder on the visor; and wherein:

the hinge comprises a hinge loop formed at the hinge end of the elongated base and a mating hinge hole formed at the hinge end of the display frame such that the hinge loop loosely passes through the mating hinge hole.

2. The placard holder of claim 1, wherein:

the frame clasp is located at an end of the elongated base distal to the hinge and is oriented for clasping an end of the display frame distal to its hinge connection.

3. The placard holder of claim 1, wherein:

the mounting body is made of formed wire.

4. The placard holder of claim 1, wherein:

the display frame comprises a planar front, a planar back, and a spring biasing the front against the back for removeably holding the placard between the front and the back;

wherein the front is transparent such that information on the placard is displayed through the front.

5. The placard holder of claim 4, wherein:

the display frame is a single sheet of material that is folded over on itself such that one folded edge is the bias spring of the display frame.

6. The placard holder of claim 4, wherein:

the front and back are elongated such that the back extends beyond one elongated end of the front;

the hinged connection is between the extended portion of the back and the mounting body; and an edge of the front is curved away from the back for casing insertion of the placard into the display frame.

7. The placard holder of claim 1, further comprising:

a single length of springy material that is formed into a clasp at a first end, then extends to form a planar base, then is looped to form a body portion of the hinge, and then finally is curved back to form a spring clip at a second end, opposite the first end, of the springy material.

8. The placard holder of claim 7, wherein:

the single length of springy material is metal; and the display frame is a single length of transparent plastic sheet material that is folded over on itself to form a front and a back that are springingly held together by a folded edge.

9. A placard holder for mounting on a visor in a vehicle, the holder comprising:

an elongated mounting body having an elongated base with a frame clasp at a first end of the base and a first portion of a hinge at a second end of the base distal to the first end;

a visor clip for removeably mounting the holder on the visor, the visor clip positioned on a first side of the plane of the base, opposed to the frame clasp which extends away from the opposed second side of the plane of the base;

a display frame with a back, a front, and a spring that biases the back against the front for removeably holding the placard; and a second portion of the hinge at an end of the display frame, the second portion mating with the first portion of the hinge for hingedly connecting the display frame to the mounting body; wherein:

the hinge comprises a hinge loop formed at the hinge end of the elongated base and a mating hinge hole formed at the hinge end of the display frame such that the hinge loop loosely passes through the mating hinge hole.

10. The placard holder of claim 9, wherein:

the display frame is shaped and positioned such that it can hingedly swing into the frame clasp for releasably clasping the display frame against the second side of the base; and the frame clasp has a spring that biases the display frame against the base when the display frame is pushed into the frame clasp, and that opposes pressure which can be applied by a user to the frame clasp for unclasping the display frame.

11. The placard holder of claim 9, wherein:

the display frame front is transparent for displaying information on a placard that is removeably held in the display frame.

12. A placard holder for mounting on a visor in a vehicle, the holder comprising:

a mounting body hingedly connected to a display frame that holds a placard;

wherein the mounting body is formed wire and comprises:

an elongated base extending from a hinge to a frame clasp that releasably clasps the display frame against the base; and a visor clip on the opposite side of the base from the frame clasp, the visor clip being spring biased toward the base for spring clipping the mounting body onto the visor, thereby removeably mounting the placard holder on the visor.

13. The placard holder of claim 12, further comprising:

a single length of springy wire having the frame clasp at a first end, then extends to form the elongated base, then is looped to form a body portion of the hinge, and then finally is curved back to form the visor clip at a second end, opposite the first end, of the springy material.

14. The placard holder of claim 13, wherein:

the frame clasp is formed from the springy wire.

* * * * *